US006029375A

United States Patent [19]

Borel

[11] Patent Number: 6,029,375

[45] Date of Patent: Feb. 29, 2000

[54] BOOT WITH LACING GUIDES

[75] Inventor: Rene Borel, Les Pres Grenier, France

[73] Assignee: Salomon S.A., Metz-Tessy, France

[21] Appl. No.: 09/115,549

[22] Filed: Jul. 15, 1998

[30] Foreign Application Priority Data

Jul. 16, 1997 [FR] France ..... 97 09330

[51] Int. Cl.[7] ..... A43C 11/08; A43C 11/12; A43C 11/22

[52] U.S. Cl. ..... 36/50.1; 24/715.2; 24/714.5; 24/714

[58] Field of Search ..... 36/50.1, 51; 24/715, 24/715.2, 714.6, 714.4, 714.5, 713.9, 714

[56] References Cited

U.S. PATENT DOCUMENTS

| | | | |
|---|---|---|---|
| 1,242,774 | 10/1917 | Curry | 24/712.6 |
| 1,289,573 | 12/1918 | Taylor | 24/714.5 |
| 1,368,971 | 2/1921 | Ross . | |
| 3,108,385 | 10/1963 | Teufel | 36/50.1 |
| 3,221,384 | 12/1965 | Aufenacker | 24/712.7 |

FOREIGN PATENT DOCUMENTS

| | | | |
|---|---|---|---|
| 0717942 | 6/1996 | European Pat. Off. . | |
| 145156 | 10/1903 | Germany . | |
| 498864 | 6/1932 | Germany . | |
| 1761170 | 2/1958 | Germany . | |
| 246605 | 4/1966 | Germany | 24/714 |
| 377225 | 6/1964 | Switzerland . | |
| 395794 | 1/1966 | Switzerland | 24/714 |
| 15314 | 11/1909 | United Kingdom . | |

*Primary Examiner*—Paul T. Sewell
*Assistant Examiner*—Anthony Stashick
*Attorney, Agent, or Firm*—Greenblum & Bernstein, P.L.C.

[57] ABSTRACT

A sport boot, especially adapted to an in-line roller skate and having an external sole overlaid by an upper including two quarters demarcating an opening which are adapted to be connected to one another by a tightening lace, along a path determined as a function of the position of return elements or guides arranged on both sides of the quarters, wherein each of the return elements or guides is constituted of a base having a flat bottom adapted to be fixed on the edge of one of the quarters of the boot, having a sliding plane, at its substantially horizontal and constant upper portion, beneath which an element is provided for passage of the lace, so as to protect the lace from any external attack.

24 Claims, 3 Drawing Sheets

20
7
2
19
25
1
25
4
3
11
4
8
11
12
8
5
12
6
12
6
12
10
6
6

BOOT WITH LACING GUIDES

BACKGROUND OF THE INVENTION

1. Field of the Invention

The present invention relates to a boot for the practice of any form of sport, but has a particularly advantageous application in the practice of so-called "aggressive" in-line roller skating.

Therefore, the boot according to the invention is especially adapted to be fixed on the upper plate of a chassis of an in-line roller skate, and has an external sole overlaid by a forwardly open upper to allow for passage of a user's foot.

To this end, it has two quarters demarcating an opening which are adapted to be connected to one another by a tightening lace.

Such a lace follows a path that is determined as a function of the position of return elements or guides, arranged on both sides of the quarters, which define a lacing zone, such that during a tractional action on the lace, the latter acts by bringing the quarters closer together to ensure the tightening of the foot.

2. Description of Background and Material Information

Generally speaking, the prior art teaches, as is the case in the documents U.S. Pat. No. 1,368,971 and CH 377 225, to carry out the lacing of the boot by means of return elements or guides constituted, for example, by eyelets provided on the edges of the boot quarters. The consequence is a rapid abrasive wear of the laces in the passing zone in the eyelets.

This is especially true for more violent sports which cause an intense friction of the top of the boot, and this is precisely the case of the so-called "aggressive" in-line roller skating which leads the user to perform gliding figures, through contact of the top of the skate along metallic rails or concrete walls, etc. It is readily understood that in this case, the laces are subjected to a very substantial abrasive effect as well as to a shearing effect.

One could think that the use of hooks, as taught by document DE 498 864, for example, could provide a solution to the problem of abrasion, for the lace would be protected by the upper portion of the hook.

While this may appear to be a solution to the problem addressed, it does however create another problem in that since the hooks are generally directed outwardly, and are therefore expressed, they in fact constitute potential hooking points with all kinds of external elements and with the boots with one another during acrobatic figures.

Therefore, this represents a real danger in this type of sport.

Consequently, it has proven indispensable to provide maximum protection for all the parts of the skate for the so-called "aggressive" in-line roller skating and, more particularly, for the upper portion of the boot upper in the lacing area.

The document GB 15,314 teaches the use of lacing hooks or equivalents which are covered by movable protective caps journalled on the fastening axes of the hooks of the boot. However, each hook is arranged in a planar configuration and is covered by the protective cap, such that passage of the lace is accessible only when the cap is rotationally displaced by the pressure applied by the lace on the cap. To actuate the opening of the cap, the lace must apply a force until overcoming the elastic resistance exerted by a leaf spring maintaining the hook in place beneath the cap. A major disadvantage is due to the fact that the lace engages into a passage of the hook that is perpendicular to the protective cap, which can cause substantial friction of the lace against the cap. Such a friction wears down the lace, especially when the lace is relatively thick, as is generally the case in sport boots. Moreover, the serial mounting of a plurality of this type of hooks can make tightening difficult due to the addition of this friction. The engagement of the lace in also uncertain due to the fact that the lace can slide along the cap without definitely opening it. In particular, such a disadvantage can appear after a while, when the rotating elements become corroded or dirty. Such a device, generally speaking, is also very complicated and expensive to make for a very questionable reliability.

Other documents, such as DE 145 156, DE 17 61 170, and EP 717 942, exist; but they provide inadequate protection for the lace, in view of the aggressive use to which it is intended in the present application.

Therefore, a system for passing the lace has been sought, to allow protection of the latter efficiently against abrasion, to facilitate the return of the lace without generating friction, and to avoid risking any hooking that would be caused by projections.

SUMMARY OF THE INVENTION

To this end, the present invention relates to a sport boot, especially adapted to be fixed on the upper plate of a chassis of an in-line roller skate and having an external sole overlaid by a forwardly open upper to allow for passage of a user's foot and including, to this end, two quarters that demarcate an opening. The quarters are connected to one another by a tightening lace, along a path that is determined as a function of the position of return elements or guides arranged on both sides of the quarters and defining a lacing zone, such that during a tractional action on the lace, the latter acts by bringing the quarters closer together to ensure the tightening of the foot. Each of the return elements or guides have a base adapted to be fixed on the edge of one of the quarters of the boot and extending in the practice of direction of the opposing quarter through an upper sliding plane, beneath which a means for passing the lace is provided. The sliding plane of a guide includes an overlapping portion to form a protective cap extending in a plane substantially parallel to the direction in which the lace passes through the passing means and above the opening demarcated by the quarters in the direction of another facing guide on the other quarter, or of another guide arranged on the same quarter, so as to protect the lace from any external aggression or during gliding on this zone of the boot during the so-called "aggressive" skating, while providing a substantially uniform gliding plane.

The present invention also relates to the characteristics which will become apparent from the description that follows, and which must be considered singly or in all of their possible technical combinations.

BRIEF DESCRIPTION OF DRAWINGS

This description, which is provided by way of non-limiting example, provides a better understanding of how the invention can be embodied, with reference to the attached drawings, in which.

DETAILED DESCRIPTION OF THE INVENTION

Figure 1:
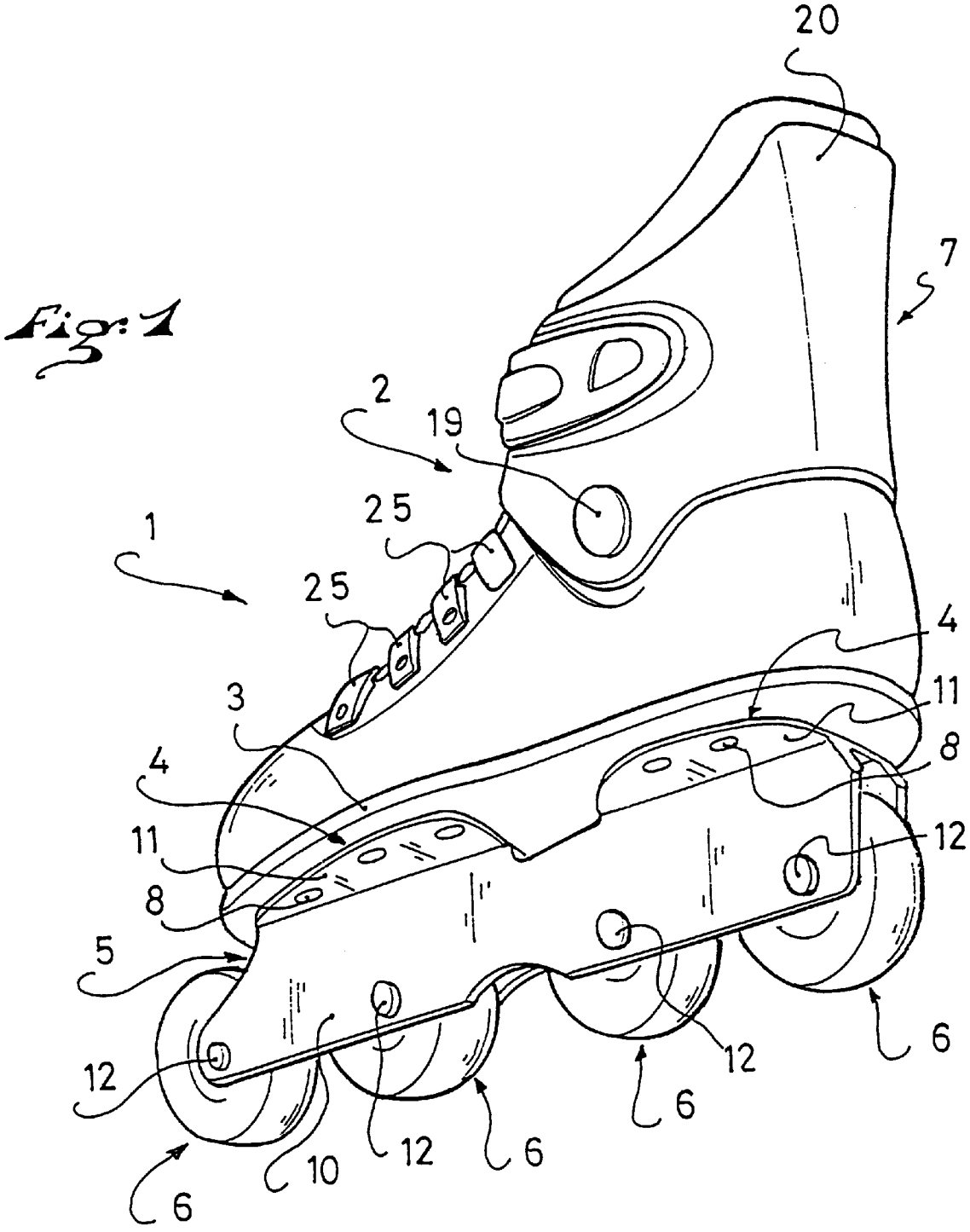
FIG. 1 is a perspective view of a boot according to the invention, associated with an in-line roller skate by way of example.

The in-line roller skate generally designated by reference numeral 1 and shown in FIG. 1 is more particularly adapted to so-called "aggressive" skating.

It includes a frame 5 having a longitudinal lower portion on which the wheels 6 are arranged, which is overlaid by a plate 4 adapted to the binding of a boot 2, formed of an upper 7 topping an external sole 3 and extended by an upper portion 20 in the direction of the ankle of a skater, constituting in fact a collar for tightening foot on the lower part of the leg, journalled on axis 19 in the area of the malleoli.

In a known manner, the sole 3 of the boot 2 is affixed to the horizontal upper plate 4, of the frame on which the sole 3 is fixed by means of fastening means, which here are screws 8 extending through the plate 4 to be tightened in the lateral edges of the sole 3.

The longitudinal lower portion of the frame 5, perpendicular to the plate 4, is constituted, for example, by two vertical lateral wings 10, parallel with one another, and arranged on both sides of the longitudinal axis.

The lateral wings 10 are respectively extended at their upper portions by a perpendicular return 11, each being directed outwardly, and constitute a plane corresponding to the horizontal plate 4.

In this way, the vertical lateral wings 10, together with the sole 3 of the boot 2, generally define an inverted U between the wings of which a plurality of wheels 6, four in number, for example, are arranged by means of transverse journal axes 12, affixed to the frame 5, to form a rolling train.

The upper 7 of the boot 2, adapted to be fixed on the plate 4 of the chassis 5 is forwardly open to allow for passage of a user's foot and has, to this end, two quarters 21, 22, demarcating an opening 23, which are adapted to be connected to one another by a tightening lace 24.

The tightening lace 24 follows a path that is determined as a function of the position of return elements or guides 25, arranged on both sides of the quarters 21 and 22 and defining a lacing zone 26.

In this way, during a tractional action on the lace 24, the latter acts by bringing the quarters 21, 22, closer together in order to close the opening 23 and ensure the tightening of the foot.

Once the quarters 21 and 22 are close to one another, they can be maintained in a tightening position on the foot in a known manner by means of a blocker (not shown) or by forming a knot on the lace.

According to the invention, each return element or guide 25 has a base 27 whose lower surface forms a flat bottom 27*a*, and which is adapted to be fixed on the edge of one of the quarters 21 or 22 of the boot 2, by means of a fastening hole 28 whose axis xx' is substantially perpendicular to the bottom 27*a* of the base.

Figure 2:
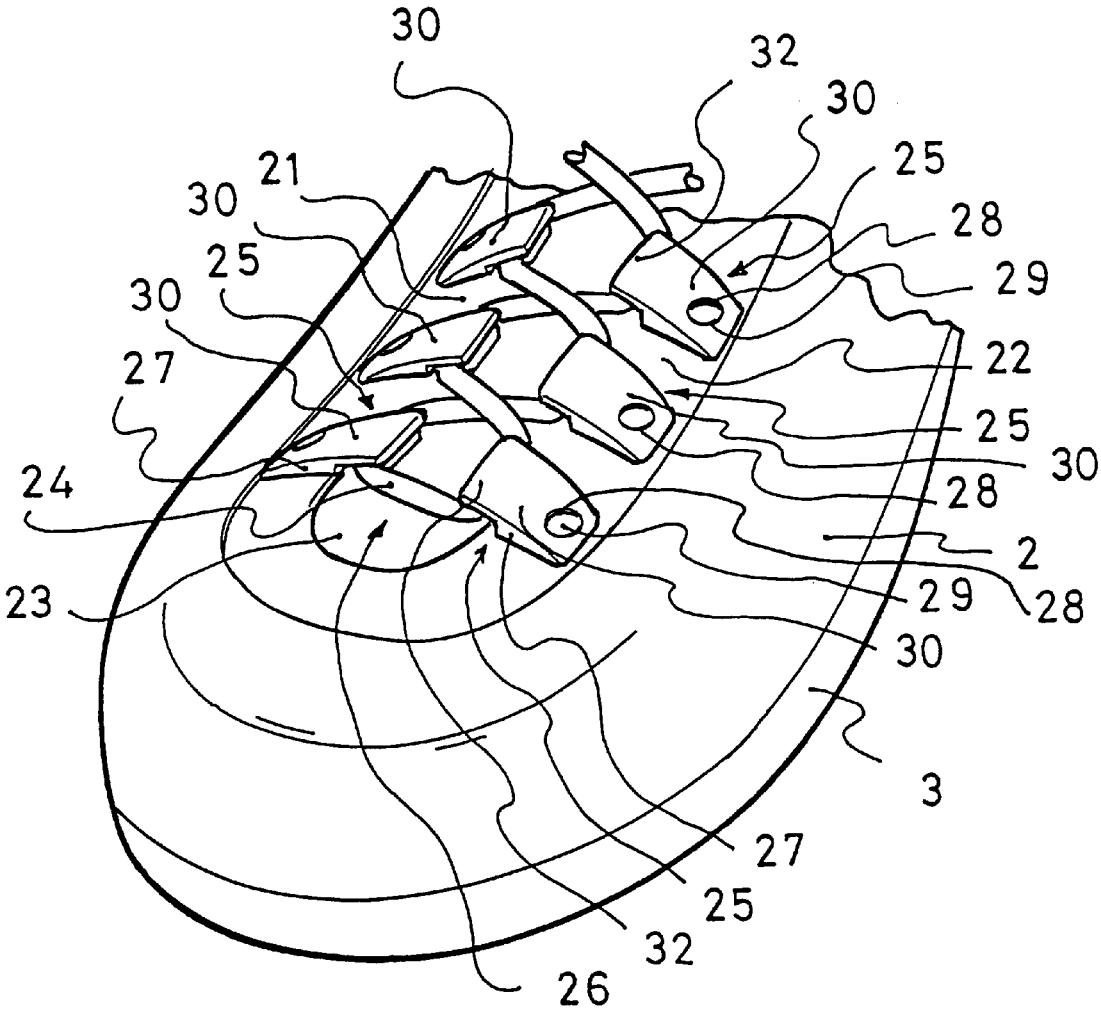
FIG. 2 is a perspective view partially showing the front upper portion of a boot upper according to the invention.
Figure 3:
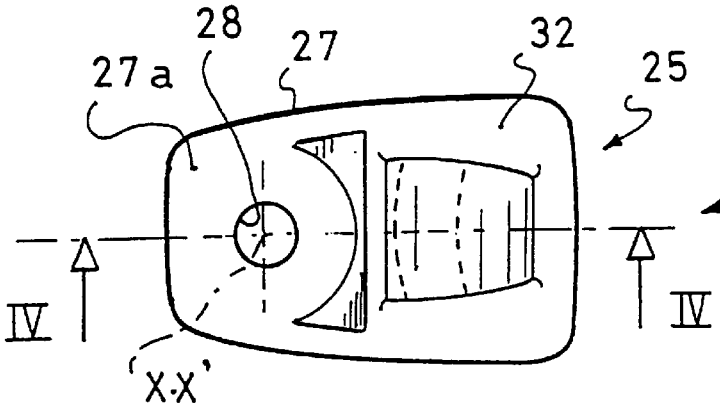
FIG. 3 is a bottom view of a return element or guide according to the invention.

The hole 28 has, at its upper portion, a spotfacing or recess 28*a* adapted to the passage of a rivet 29. As can be seen in FIG. 2, the entireties of the return elements or guides 25 are visible, i.e., exposed, on the upper surface of the quarters.

The base 27 of a return element or guide 25 fixed on one of the quarters 21 or 22 extends in the direction of an opposing quarter 21 or 22 by forming an upper sliding plane 30 statically affixed to the base 27. This upper plane 30 is substantially planar, so as to facilitate the sliding, but nevertheless has a slight curvature in the longitudinal direction to form a harmonious transition between the side of the associated quarter 21, 22 and the top of the upper.

Figure 4:
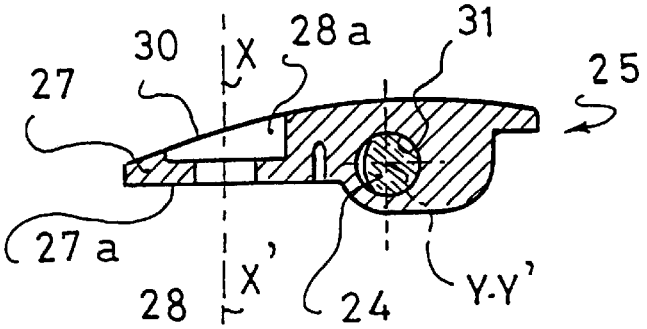
FIG. 4 is a longitudinal cross-sectional view along the line IV—IV of FIG. 3.
Figure 5:
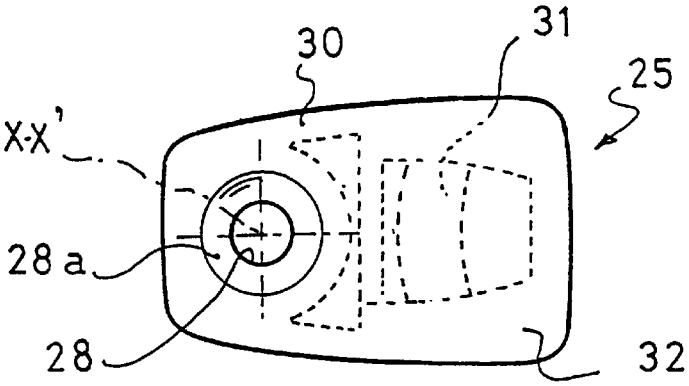
FIG. 5 is a top view of a return element or guide according to one of the preceding figures.

A passage 31 for the lace 24 is provided beneath the upper sliding plane 30. As can be seen in FIG. 4, the slight curvature of the sliding plane 30 an arc of curvature that is longer than the radius of curvature of the passage 31.

In this way, while providing a substantially uniform sliding plane, an efficient protection of the lace 24 is obtained against any external attack or when gliding on this zone of the boot 2, during so-called "aggressive" skating.

According to another characteristic of the invention, and in order to further improve the protection of the lace, the sliding plane 30 of each guide 25 includes an overlapping portion 32 along the longitudinal direction yy' of the boot, both in the transverse direction of the boot (i.e., in the longitudinal direction with respect to the guide) and in the longitudinal direction of the boot, to constitute a protective cap extended by a projection, on both side of the passage 31, above the opening 23 demarcated by the quarters 21 and 22, in the direction of another guide 25 arranged on the side on the same quarter, or opposite on the other quarter 21 or 22.

According to the embodiment shown in the figures, the element 31 for passage of the lace 24 provided beneath the protective cap 32 has a closed annular portion through which is arranged a substantially horizontal hole having a circular transverse section, an axis yy' perpendicular to the axis xx' of the hole 28 for fastening the base 27 of the guide 25. The hole 31 of the annular portion is preferably slightly incurved for better sliding of the lace 24.

Figure 6:
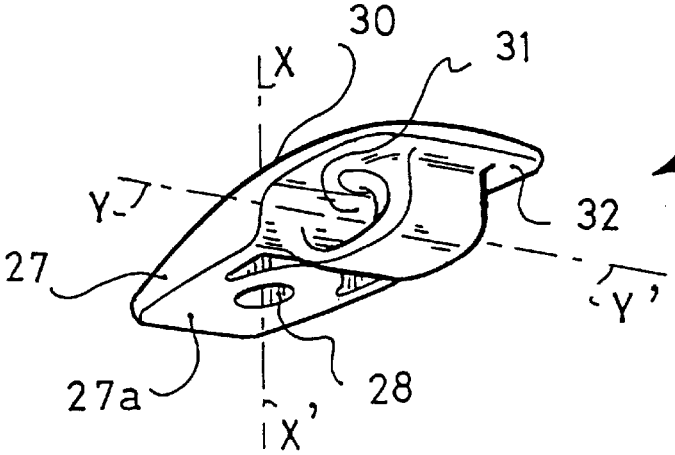
FIG. 6 is a bottom perspective view of a return element or guide according to one FIGS. 2–5.

As shown in FIG. 6, the sliding plane 30 of the guide has an overlapping portion 32 which has projecting edges extending beyond the closed annular portion, both in the longitudinal direction yy' of the boot (corresponding to the direction of passage of the lace) and in the transverse direction zz' of the boot (i.e., longitudinal with respect to the guide itself).

According to an alternative embodiment of the invention, the element 31 for passage of the lace 24 provided beneath the protective cap 32 is an open portion forming a hook (not shown) directed toward the hole 28 for fastening the base 27 of the guide 25 and made substantially horizontal and perpendicular to the axis xx' of the fastening hole 28.

Advantageously, the return element or guide 25 is made integral by molding of a plastic material.

The invention is not limited to the particular embodiments shown and described, but can include other close or equivalent variations covered by the claims that follow.

The instant application is based upon French Patent Application No. 97 09330 filed on Jul. 16, 1997, the disclosure of which is hereby incorporated by reference thereto in its entirety, and the priority of which is hereby expressly claimed under 35 USC 119.

What is claimed is:

1. A boot comprising:

an external sole;

an upper extending upwardly from said sole, said upper having a pair of laterally opposed quarters, an opening between said quarters at a forward part of said upper for allowing passage of a user's foot, said opening extending in a longitudinal direction;

a plurality of lace return elements positioned on said quarters, thereby defining a lacing zone, each of said plurality of lace return elements comprising:

a base having a lower surface fixed upon one of said quarters;

an upper surface defining a sliding plane, said sliding plane extending transversely in a direction toward an opposite one of said quarters;

a passage for a lace beneath said sliding plane, said passage extending generally in the longitudinal direction of the opening of said upper, said sliding plane including an overlapping portion, defining a protective cap, said overlapping portion extending longitudinally beyond said lace passage and extending transversely beyond said lace passage in a direction away from said base and being positioned above said opening of said upper; and a lace extending through certain ones of said passages of said lace return elements and extending across said opening of said upper to facilitate tightening of said upper upon the user's foot upon application of a traction force on said lace to bring said quarters closer together.

2. A boot according to claim 1, wherein:

said sliding plane of each lace return element extends in directions toward an adjacent lace return element on one of said quarters of said upper and toward an opposed lace return element on a second of said quarters.

3. A boot according to claim 1, wherein:

each of said lace return elements includes a hole extending in a direction through said base, and a fastener extending through said hole to secure each said lace return element to said upper; and said passage for each of said lace return elements extends generally in a direction perpendicular to said direction of said hole.

4. A boot according to claim 3, wherein:

said passage for said lace beneath said sliding plane is formed by a hook, said hook being open in a direction facing said hole in said base.

5. A boot according to claim 3, wherein:

said fasteners for securing said lace return elements to said upper are rivets.

6. A boot according to claim 1, wherein:

each of said lace return elements is molded as a single piece of plastic material.

7. A boot according to claim 1, wherein:

each of said lace returns has an outer periphery, the entirety of said outer periphery being exposed on said upper.

8. A boot according to claim 1, wherein:

each of said lace return elements has no relatively movable parts.

9. A boot comprising:

an external sole;

an upper extending upwardly from said sole, said upper having a pair of laterally opposed quarters, an opening between said quarters at a forward part of said upper for allowing passage of a user's foot, said opening extending in a longitudinal direction;

a plurality of lace guides positioned on said quarters, each of said plurality of lace guides comprising:

a base having a lower surface fixed upon one of said quarters;

a passage for a lace, said passage extending generally in the longitudinal direction of the opening of said upper;

an uppermost sliding surface extending over said passage, said uppermost sliding surface including an overlapping portion extending longitudinally beyond said lace passage and extending transversely beyond said lace passage in a direction away from said base; and a lace extending through certain ones of said passages of said lace guides and extending across said opening of said upper to facilitate tightening of said upper upon the user's foot upon application of a traction force on said lace to bring said quarters closer together.

10. A boot according to claim 9, wherein:

said overlapping portions of said lace guides are positioned over said opening of said upper.

11. A boot according to claim 9, wherein:

said sliding surface of each lace guide extends in directions toward an adjacent lace guide on one of said quarters of said upper and toward an opposed lace guide on a second of said quarters.

12. A boot according to claim 9, wherein:

each of said lace guides includes a hole extending in a direction through said base, and a fastener extending through said hole to secure each said lace return element to said upper; and said passage for each of said lace guides extends generally in a direction perpendicular to said direction of said hole.

13. A boot according to claim 12, wherein:

said passage for said lace beneath said sliding surface is formed by a hook, said hook being open in a direction facing said hole in said base.

14. A boot according to claim 12, wherein:

said fasteners for securing said lace guides to said upper are rivets.

15. A boot according to claim 9, wherein:

each of said lace guides is molded as a single piece of plastic material.

16. A boot according to claim 9, wherein:

each of said lace returns has an outer periphery, said uppermost sliding surface extends to and along the entirety of said outer periphery.

17. A boot according to claim 9, wherein:

said uppermost sliding surface is defined by an arc of curvature.

18. A boot according to claim 17, wherein:

said arc of curvature of said uppermost sliding surface is larger than a radius of curvature of said passage.

19. A boot according to claim 16, wherein:

said uppermost sliding surface is defined by an arc of curvature.

20. A boot according to claim 17, wherein:

said arc of curvature of said uppermost sliding surface is larger than a radius of curvature of said passage.

21. A boot according to claim 16, wherein:

said uppermost sliding surface is substantially uniform.

22. A boot according to claim 9, wherein:

each of said lace returns has an outer periphery, the entirety of said outer periphery being exposed on said upper.

23. A boot according to claim 9, wherein:

each of said lace guides has no relatively movable parts.

24. An in-line roller skate comprising:

(A) a frame having an upper plate and a pair of laterally spaced apart wings;

(B) a plurality of wheels rotatably mounted between said wings of said frame;

(C) a boot comprising:

(1) an external sole;

(2) an upper extending upwardly from said sole, said upper having a pair of laterally opposed quarters, an opening between said quarters at a forward part of said upper for allowing passage of a user's foot, said opening extending in a longitudinal direction;

(3) a plurality of lace return elements positioned on said quarters, thereby defining a lacing zone, each of said plurality of lace return elements comprising:

(a) a base having a lower surface fixed upon one of said quarters;

(b) an upper surface defining a sliding plane, said sliding plane extending transversely in a direction toward an opposite one of said quarters;

(c) a passage for a lace beneath said sliding plane, said passage extending generally in the longitudinal direction of the opening of said upper, said sliding plane including an overlapping portion, defining a protective cap, said overlapping portion extending longitudinally beyond said lace passage and extending transversely beyond said lace passage and above said opening of said upper; and (4) a lace extending through certain ones of said passages of said lace return elements and extending across said opening of said upper to facilitate tightening of said upper upon the user's foot upon application of a traction force on said lace to bring said quarters closer together.

* * * * *